US005088475A

United States Patent [19]

Steffensmeier

[11] Patent Number: 5,088,475

[45] Date of Patent: Feb. 18, 1992

[54] CHIROPRACTIC MASSAGE TABLE

[76] Inventor: Lloyd A. Steffensmeier, 102-122 West Main St., Lisbon, Iowa 52253

[21] Appl. No.: 539,726

[22] Filed: Jun. 15, 1990

[51] Int. Cl.[5] ..... A61H 7/00

[52] U.S. Cl. ..... 128/52; 128/57; 128/33

[58] Field of Search ..... 128/52, 51, 57, 33; 297/204, 208, 209, 318, 205, 206, 207, 331, 332; 38/103, 108, 112

[56] References Cited

U.S. PATENT DOCUMENTS

| | | | |
|---|---|---|---|
| 652,183 | 6/1900 | Hinrichs | 297/209 |
| 1,238,078 | 8/1917 | Ault | 297/317 |
| 3,664,333 | 5/1972 | Hill | 128/52 |
| 3,830,233 | 8/1974 | Hill | 128/52 |
| 3,882,856 | 5/1975 | Heuser | 128/52 |

FOREIGN PATENT DOCUMENTS

| | | | |
|---|---|---|---|
| 3758 | of 1914 | United Kingdom | 297/208 |
| 128369 | 6/1918 | United Kingdom | 297/208 |

*Primary Examiner*—Robert A. Hafer
*Assistant Examiner*—David J. Kenealy
*Attorney, Agent, or Firm*—James C. Nemmers

[57] ABSTRACT

A chiropractic massage table for producing therapeutic massage in a specified area of a patient's spine. Three pair of tandemrollers are mounted on the periphery of a rotatable support which travels along a defined path beneath the surface of the table. The rollers are also mounted so as to float upwardly and downwardly against resistance thereby adjusting the pressure of the rollers to conform to the cervical, thoracic, lumbar and sacral curvatures of the patient's spine.

7 Claims, 2 Drawing Sheets

CHIROPRACTIC MASSAGE TABLE

BACKGROUND OF THE INVENTION

In the treatment of various conditions of the spine, therapists and doctors have used specially designed tables to generate intersegmental traction which put the spine in various ranges of motion, thereby affecting the flow of spinal fluid either in preparation for a more effective spinal adjustment or as an ultimate therapeutic treatment. These tables attempt to provide musculoskeletal massage along the spine in order to produce a particular desired result. However, the prior art therapeutic tables of this type generally provide rollers that are rotatable about a central axis, with the rollers moveable along a defined path so as to produce a desired effect along a portion of the spine. The prior art tables, however, have a very limited range of travel, and the massage rollers are not adjustable upwardly and downwardly against resistance, nor are they designed so as to be free floating in a manner that effectively exerts a constant pressure along the curvatures of the spine. Moreover, prior art therapeutic tables of this type utilize single wide rollers that move along the spine and thus do not apply sufficient pressure to the muscles adjacent to the spine.

There is therefore a need for an improved therapeutic massage table of this type which will apply more uniform pressure along the entire length of the spine, and apply that pressure to the muscles lying adjacent to the spine over a longer range of travel. Such an improved table would produce more effective intersegmental traction. There is a further need for such a table that has sufficient flexibility for the practitioner to be able to locate the massage rollers in any position along their path thereby effectively give concentrated massage upon a selected area of the spine.

There is a further need for a therapeutic massage table to generate intersegmental traction which massage table is simple for the practitioner to operate, relatively inexpensive to purchase and easy to maintain.

SUMMARY OF THE INVENTION

The therapeutic massage table of the invention utilizes three pairs of tandem rollers mounted equidistant around the periphery of a rotatable support, which support is in turn mounted on a spring-biased scissors-type supporting structure which allows both vertical adjustment and free floating of the rollers. The entire tandem-roller supporting structure is mounted on a moveable carriage which travels length-wise of the table through a relatively long range of travel to allow the therapy to be applied over the full range of the spine. The tandem rollers are spaced apart a proper distance so as to straddle the spine, and the range of travel can be quickly and easily adjusted so that the direction of travel of the carriage is automatically reversed at each end of the range of travel.

DESCRIPTION OF THE PREFERRED EMBODIMENT OF THE INVENTION

Figure 1:
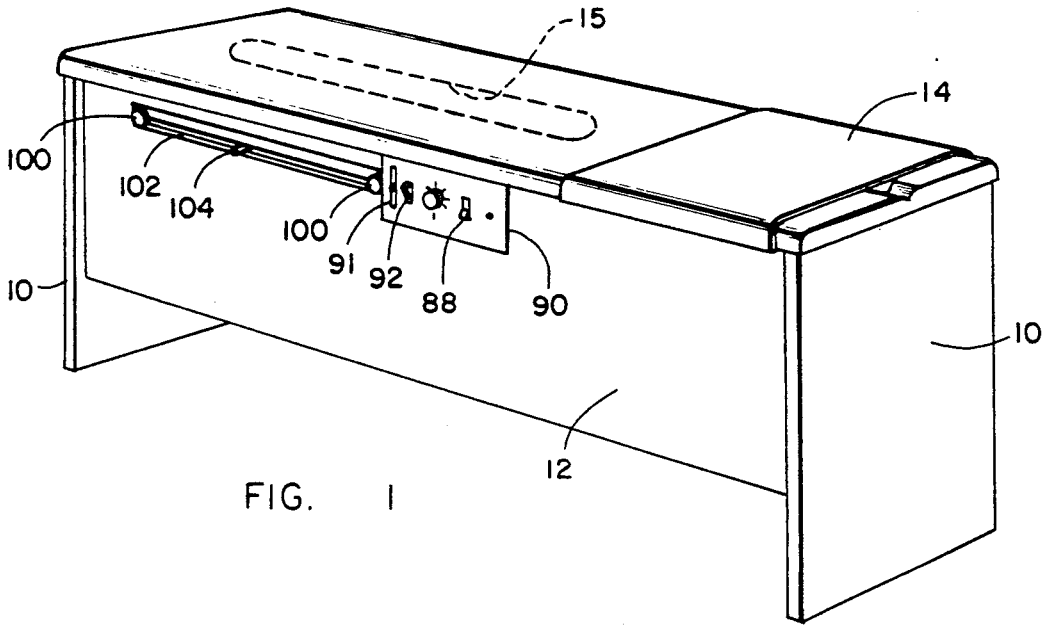
FIG. 1 is a perspective view of a table of the type to which the invention relates.
Figure 2:
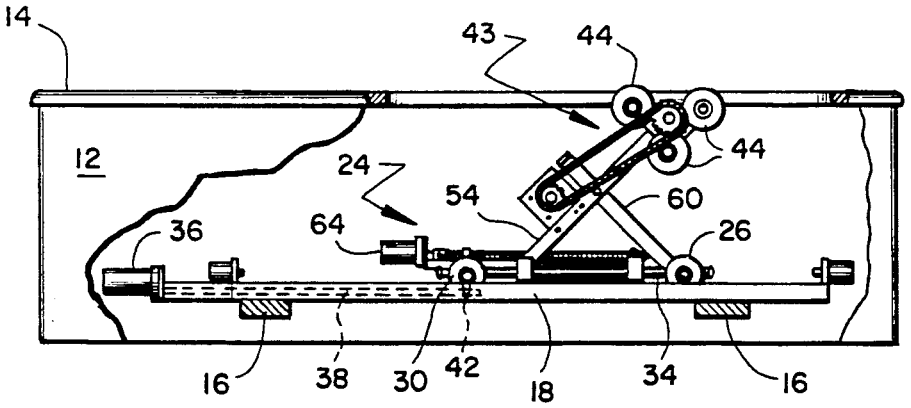
FIG. 2 is a side elevational view of the table with the side panel partly broken away to show the operation mechanism.
Figure 3:
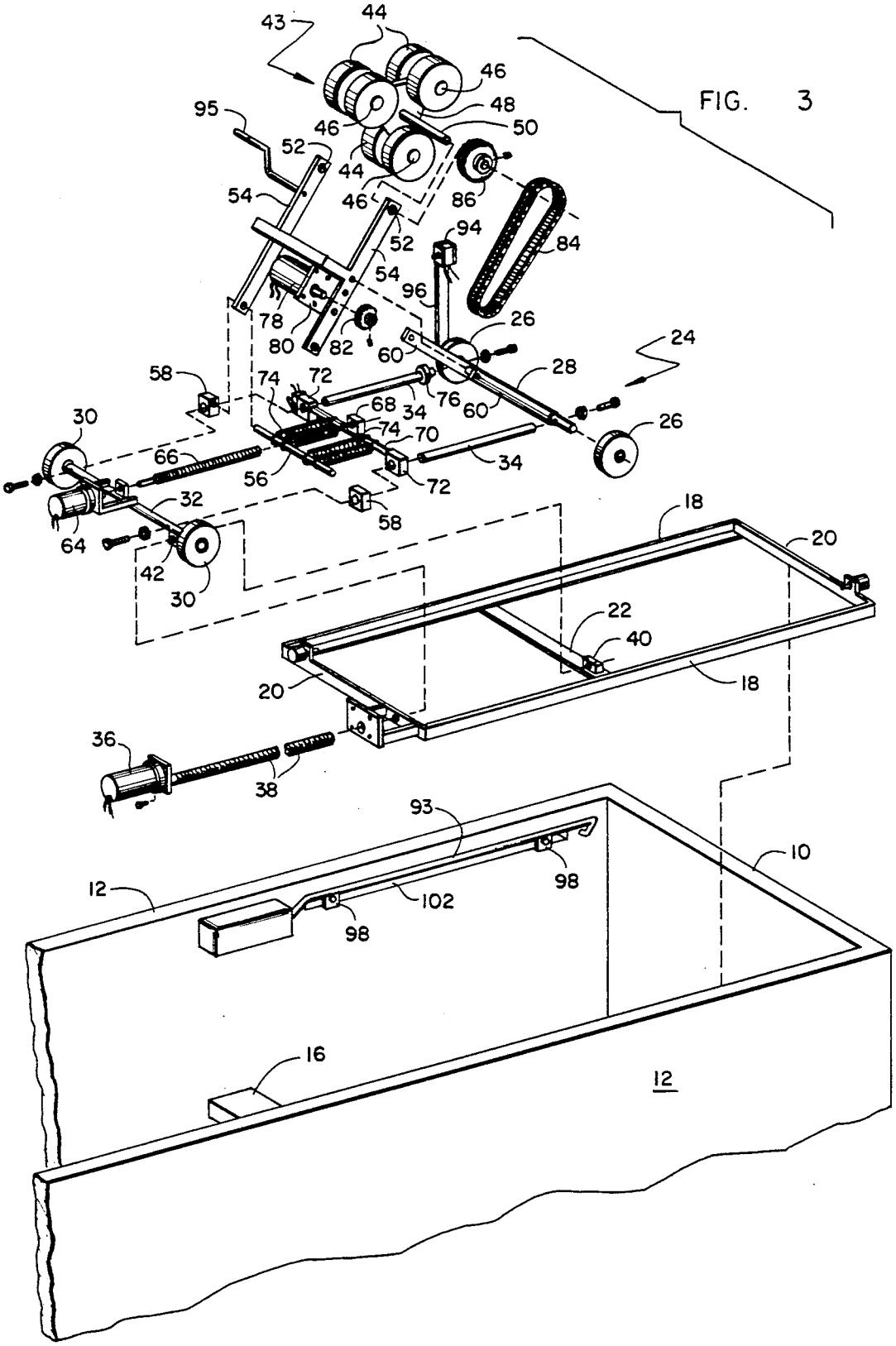
FIG. 3 is a perspective exploded view of the operating mechanism of the invention.

The table of the invention can be of any suitable exterior design that includes end supports 10 that are joined together by side panels 12 and a table top 14 that supports the patient's body. Top 14 has an elongated opening 15 in the center near one end, the opening being covered with the covering material that covers the rest of the top 14. Inside the end supports 10 and side panels 12 are cross support members 16 that support longitudinally extending frame members 18 near the bottom of the side panels 12. Frame members 18 are preferably formed of angle irons that provide horizontal tracks. The frame members or tracks are referred to hereinafter simply as tracks 18, and they extend along the inside edge of each of the side panels 12. Tracks 18 are supported at their ends by cross supports 20 and also by an intermediate cross member 22.

Moveable along the tracks 18 is a carriage indicated generally by the reference numeral 24. Carriage 24 has a pair of front wheels 26 supported by an axle 28 and a pair of rear wheels 30 joined by axle 32. Axles 28 and 32 are joined together at their outer ends by longitudinally extending rods 34. This basic frame for carriage 24 is constructed so that the wheels 26 and 30 are engageable with the tracks 18 enabling the carriage 24 to move longitudinally along tracks 18 inside of the table.

To provide for controlled movement of the carriage 24, an electric motor 36 is mounted in any suitable manner at one side of the rear cross support 20. Motor 36 is connected to one end of a threaded shaft 38 which is driven by motor 36. The other end of shaft 38 is turnable in a support block 40 mounted on the intermediate cross member 22. Carriage 24 has secured to its rear axle 32 a block 42 that contains a threaded opening through which shaft 38 extends. Thus, when shaft 38 is rotated, carriage 24 will be moved forwardly or rearwardly depending upon the direction of rotation of shaft 38.

To provide the desired musculoskeletal massage along the area of the patient's spine, the carriage 24 supports a massage roller assembly indicated generally by the reference numeral 43. This assembly 43 includes three pair of tandem-mounted massage rollers 44 which are positioned to move along in the elongated opening 15 in the table top 14. Each pair of tandem rollers 44 is supported on an axle 46 which in turn is secured to a support plate 48. The axles 46, and thus the rollers 44, are spaced around the periphery of support plate 48 at substantially equal distances. Support plate 48 has a centrally located shaft 50 that is turnable in a pair of bearings 52 mounted in the upper ends of a pair of spaced-apart support arms 54. The lower ends of support arms 54 are pivotally mounted on an axle 56, and the outer ends of arms 54 are attached to rear bearing blocks 58 which are longitudinally slidable along the rods 34 of the carriage 24. A second pair of support arms 60 are pivotally secured at the their upper ends to the support arms 54 at approximately the middle of support arms 54. The lower ends of the second set of support arms 60 are pivotally supported on axle 28 which supports wheels 28. In order to provide for adjustability of the height of the massage rollers 44, there is connected to the rear axle 32 an electric motor 64 which is operatively connected to a threaded shaft 66 the outer end of which is engaged in a support block 68 affixed to the cross member 70. Cross member 70 has its ends seated in blocks 72, which are in turn slidably mounted on the rods 34. Springs 74 interconnect the axle 56 and cross member 70 to bias them toward each other, and because of the scissors-type connection of the support arms 54 and 60, the massage rollers 44 are biased upwardly but are free to move downwardly when axle 56 is pushed away from cross member 70 against the force of the springs 74. Roller 76 on rod 34 engages one of the arms 60 to minimize lateral movement. Thus, when the threaded shaft 66 is rotated by motor 64, block 68 will travel along shaft 66 and move cross member 70 to vary the relative distance between member 70 and axle 28. Because of the scissors type support arrangement previously described for the massage rollers 44, the massage rollers 44 will be raised or lowered depending upon the direction of rotation of the threaded shaft 66.

A control panel 90, which is mounted at a convenient location on one of the side panels 12 of the table, has a switch 92 that controls operation of the motor 64 thereby providing the operator an easy means for adjustment of the height of the massage rollers 44. Control panel 90 also has a height indicator 91 that extends through the control panel 90 and is connected to a horizontal bar 93 mounted on the inside of side panel 12 just above a slot 102 that is formed in side panel 12 near the top 14. Bar 93 is engaged by a fixed arm 95 secured to one of the support arms 54 of the roller assembly 43, and as the roller assembly 43 is raised or lowered, the bar 93 will be raised or lowered by arm 95 thereby moving the indicator 91. In this manner, the operator can tell at a glance the height of the massage rollers 44.

As is evident from the foregoing description, the massage roller assembly 43 is supported and carried by carriage 24 which travels along the tracks 18 within the defined limits of the lengths of tracks 18. As the carriage 24 moves along tracks 18 driven by motor 36 and the threaded shaft 38, the massage rollers 44 are constantly rotated at a slow speed. This is accomplished by a separate electric motor 78 mounted on a support member 80 secured to one of the support arms 54. The motor 78 drives a small gear 82 which, through chain 84, drives a larger gear 86 connected to the axle 50. Motor 78 is reversible and is controlled by a switch 88 on the control panel 90.

Since the carriage 24 can travel only a limited distance, the carriage 24 is preferably automatically reversed in direction at the time it reaches the limits of its travel in one direction. Also, it is preferable that the amount of travel of the carriage 24 in each direction be adjustable. In the apparatus of the invention, this is accomplished by providing a switch 94 that is mounted on a support 96 secured to the carriage 24. In the drawings, support 96 is shown as being mounted at the outer end of the axle 28 at the forward end of the carriage 24. The support arm 96 extends vertically, and is mounted for limited pivotal movement about its lower end, which is attached to the axle 28. Secured to the inside of the side panel 12 on the side of the carriage where the switch 92 is located are a pair of horizontally spaced apart stops 98. Operating handles 100 extend through a slot 102 in the side panel 12 so that the position of each of the stops 98 can be individually adjusted. Stops 98 are in the path of the support arm 96 carrying switch 94, and when the support arm 96 strikes a stop 98, switch 94 is actuated to reverse the motor 36 and thus reverse the direction of movement of the carriage 24. To accomplish this, switch 94 is preferably a mercury switch so that it will be operable when the support arm 96 tilts in either direction at the time it engages one of the stops 98. The same purpose could be accomplished by the use of a micro switch mounted on support arm 96, with the switch being triggered by contact with one of the stops 98.

Also, an indicator 104 preferably is mounted on the support 96 with the outer end of indicator 104 extending through slot 102 so that the operator can see the position of the carriage 24 and position it properly for the desired therapy.

The operation of the apparatus of the invention should be evident from the foregoing description, but its operation is summarized as follows. The pairs of massage rollers 44 are mounted so that they can be slowly revolved around a horizontal axis, with each pair of rollers 44 in tandem and spaced apart an appropriate distance to straddle the patient's spine. The massage rollers 44 are mounted on scissors-type support arms 54 and 60 that are biased upwardly by springs 74, but the structure permits the entire massage roller assembly to move upwardly and downwardly under variable pressure so that the massage rollers 44 will always conform to the cervical curve as well as the thoracic lumbar and sacrum areas of the patient. The massage roller assembly also provides for adjustable height of the rollers 44, and the entire massage roller assembly is mounted on carriage 24 which is controllably moved longitudinally of the table along tracks 18. The direction of the movement of the carriage 24 is reversible so that when the carriage 24 reaches the end of its travel in one direction, it will automatically reverse and move in the other direction to the end of the path where it will again reverse direction. The length of travel of the carriage 24 is adjustable by the operator by moving operating knobs 100 to change the position of the stops 98. Thus, the revolving rollers 44 apply substantially constant pressure to the muscles along and on both sides of the patient's spine, adapting automatically so as to conform to the curvature of the spine. The length of the path that the massage rollers 44 travel along the spine is adjustable by the operator depending upon the desired range of motion.

With the apparatus of the invention, it will be thus seen that the operator can control precisely the area of the spine to be treated and apply concentrated massage on a specified area of the spine. The design of the revolving rollers mounted on a moveable carriage of the type disclosed herein provides for a path of travel of a length longer than the path provided by any apparatus of the prior art. Thus, the adaptability of the apparatus of the invention provides the physician with a wide range of therapies while providing precise musculoskeletal massage control in all of the therapies.

Having thus described the invention in connection with the preferred embodiment of it, it will be evident to those skilled in the art that various revisions and modifications can be made to the preferred embodiment described herein without departing from the spirit and scope of the invention. It is my intention, however, that all such revisions and modifications as are obvious to those skilled in the art will be included within the scope of the following claims.

What is claimed is as follows:

1. A therapeutic massage table for providing musculoskeletal massage along a patient's spine, said table comprising: a top having sides and ends supporting the table top at a level above the floor, the table providing for support of the patient's body in a supine position on the top, the table top having an elongated opening formed therein between the ends, a carriage moveable between the ends of the table beneath the elongated opening in the top, a first support arm extending upwardly from the carriage and pivotally connected at its lower end to the carriage about a first pivot means that is fixed relative to the carriage, a second support arm extending upwardly from the carriage and pivotally connected at its lower end to the carriage about a second pivot means that is movable relative to the carriage toward and away from the first pivot means, the first support arm being pivotally connected near its upper end to the second support arm at a point between the ends of the second support arm, spring means biasing the lower ends of the support arms toward each other, massage rollers supported at the upper end of the second support arm and positioned so as to be extendible through the elongated opening for engagement with the back of a patient supported on the table top over the elongated opening, the massage rollers including two or more pairs of tandem-mounted rollers, each such pair being rotatable about an axis that is spaced radially outwardly from a common axis so that the pairs are rotatable as a unit, means for rotating the pairs of rollers about said common axis, and power means for moving the carriage and thus the rollers along the back of a patient properly positioned on the table, the spring means biasing the rollers toward the patient's body while providing for limited movement of the rollers away from the patient's body against resistance of the spring means.

2. The table of claim 1 in which there is provided means controller by the operator of the table for adjusting the height of the massage rollers relative to the top of the table.

3. The table of claim 2 in which the carriage has moveable supports and the spring means is connected to the moveable supports of the carriage and to the second pivot means, and the adjustment means is connected to the moveable supports to provide for varying the position of the moveable supports relative to the second pivot means and thus vary the position of the second pivot means relative to the first pivot means.

4. The table of claim 3 in which the table includes parallel spaced-apart tracks extending from one end of the table toward the other end beneath the elongated opening in the top and in a plane substantially parallel to the top, and the carriage has a plurality of wheels engageable with the tracks.

5. The table of claim 4 in which the carriage includes front and rear axles supporting the wheels, rods extend along each side of the carriage between the axles, the first support arm is pivotally connected to the front axle, the second pivot means for the second support arm is operatively connected to the carriage rods for movement relative to and along the rods, and the spring means interconnects the second pivot means of the second support arm and the moveable supports of the carriage to bias the lower end of the second support arm toward the first support arm, the adjustment means determining the height of the massage rollers and the spring means providing for movement of the massage rollers away from the patients body against the resistance of the springs.

6. The table of claim 5 in which adjustable stops are provided in the path of movement of the carriage in either direction so as to limit the movement of the carriage in either direction and thereby limit the movement of the massage rollers along the elongated opening in the table top.

7. The table of claim 6 in which means is provided to automatically reverse the direction of the carriage when it reaches the limit of its travel in either direction along the tracks.

* * * * *